United States Patent [19]

Åstrand

[11] 4,086,025

[45] Apr. 25, 1978

[54] PROPELLERS WITH RETRACTABLE BLADES

[76] Inventor: Sven Ingvar Åstrand, Barristigen 14, S-151 50 Sodertalje, Sweden

[21] Appl. No.: 714,128

[22] Filed: Aug. 13, 1976

[30] Foreign Application Priority Data

Aug. 22, 1975 Sweden ..... 7509357

[51] Int. Cl.[2] ..... B63H 1/24

[52] U.S. Cl. ..... 416/142; 416/166

[58] Field of Search ..... 416/133, 140, 142, 143, 416/149, 166, 167

[56] References Cited

U.S. PATENT DOCUMENTS

| | | | |
|---|---|---|---|
| 731,020 | 6/1903 | Charles | 416/142 |
| 866,369 | 9/1907 | Learnard | 416/142 |
| 938,291 | 10/1909 | Thompson | 416/142 |
| 1,491,512 | 4/1924 | Bracco | 416/142 |
| 2,477,944 | 8/1949 | Rouse | 416/140 |
| 2,638,171 | 5/1953 | Foss | 416/140 X |

FOREIGN PATENT DOCUMENTS

| | | | |
|---|---|---|---|
| 2,300,812 | 7/1974 | Germany | 416/142 |
| 358,771 | 4/1938 | Italy | 416/140 |
| 60,488 | 12/1939 | Norway | 416/142 |
| 878,852 | 10/1961 | United Kingdom | 416/142 |

*Primary Examiner*—Everette A. Powell, Jr
*Attorney, Agent, or Firm*—Gerald J. Ferguson, Jr; Joseph J. Baker

[57] ABSTRACT

The present invention relates to a propeller with retractable blades arranged on a hub, said hub being limitedly rotatable in relation to the propeller drive shaft, each of said blades being pivotable between an outward working position and an inward inactive position, whereby power and movement transmission means determining the pivoting position of the blades unites the drive shaft and the blades and is arranged at least when the propeller rotates in one of its both directions of rotation to compulsorily open out the blades by mutual turning movement between the drive shaft and hub. The propeller is particularly, but not exclusively, intended for competition sailing boats to give the least amount of resistance when the boat is under sail and the propeller retracted. Previous constructions have not functioned completely reliably in practice, especially not when reversing.

4 Claims, 5 Drawing Figures

PROPELLERS WITH RETRACTABLE BLADES

The object of the invention is to provide a propeller which with complete reliability opens at forward as well as reverse speed, and which gives the greatest possible power in both directions. The intended result is achieved by giving the propeller the distinguishing features disclosed in claim 1.

An embodiment of the invention is described more closely below while referring to the attached drawing.

Figure 1:
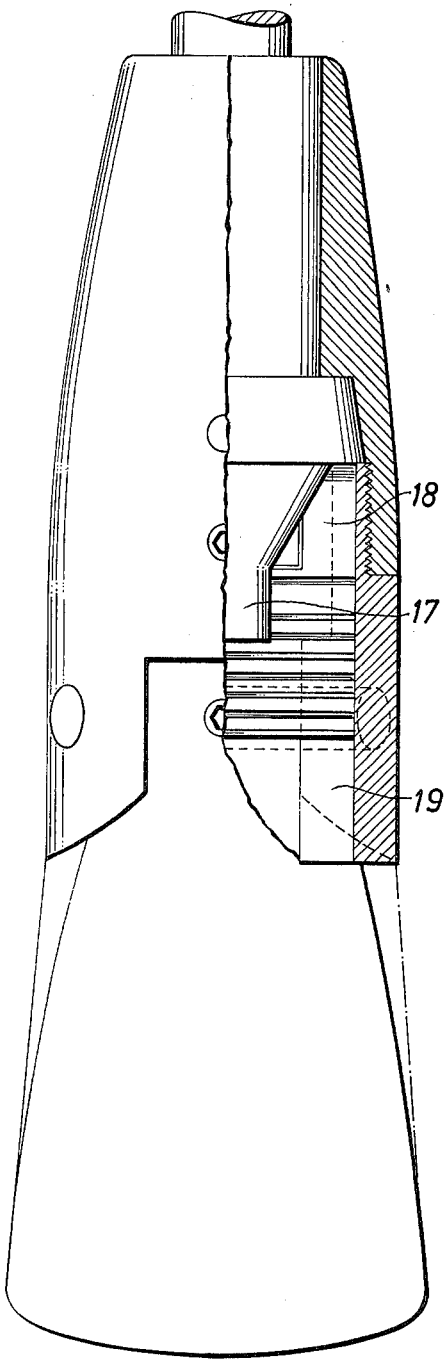
FIG. 1 shows an embodiment of the propeller according to the invention, partly in section, in the retracted position.

In FIG. 1 the numerals 1 denote drive shaft, 2 key, 3 a stop on the drive shaft for a driving dog, 4 the forward portion of the propeller hub, 5 the drive shaft nut, 6 the locking screw for the drive shaft nut, 7 access hole for tool to the drive shaft nut locking screw, 8 the propeller hub rear portion, 9 thread for joining the forward and rear portions of the propeller hub, 10 screw for locking said thread, 11 said driving dog, 12 locking screw for propeller blade stub, 13 propeller blade stubs, 14 gear segment, 15 rack, 16 propeller blade, 17 dog pins, 18 rack pins, 19 guide groove for rack, 20 stop.

Figure 2:
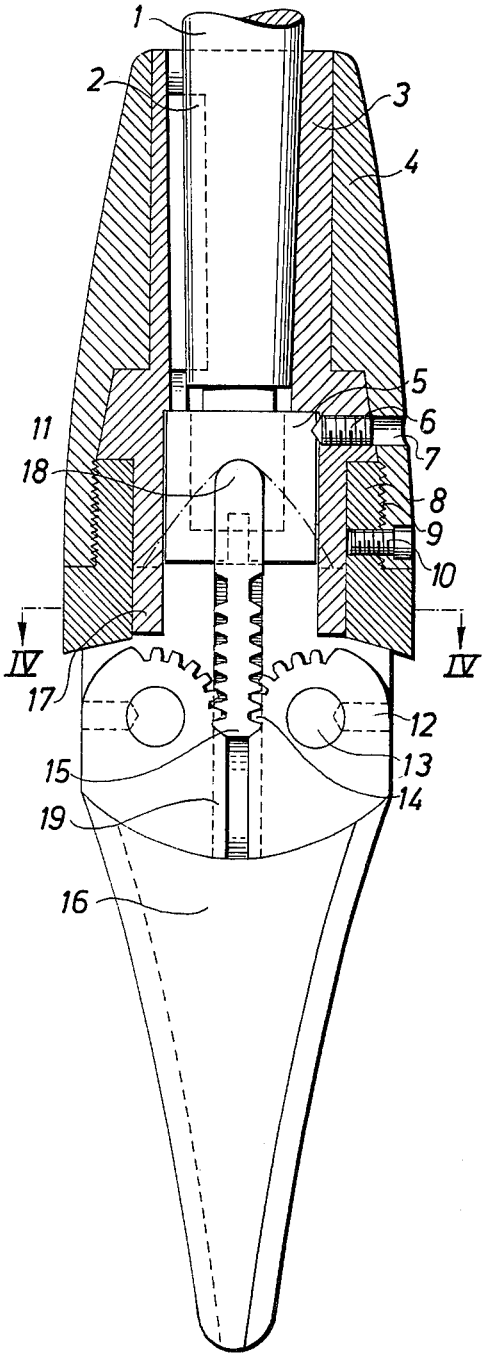
FIG. 2 shows the same propeller in another view, taken normally to that in FIG. 1.
Figure 3:
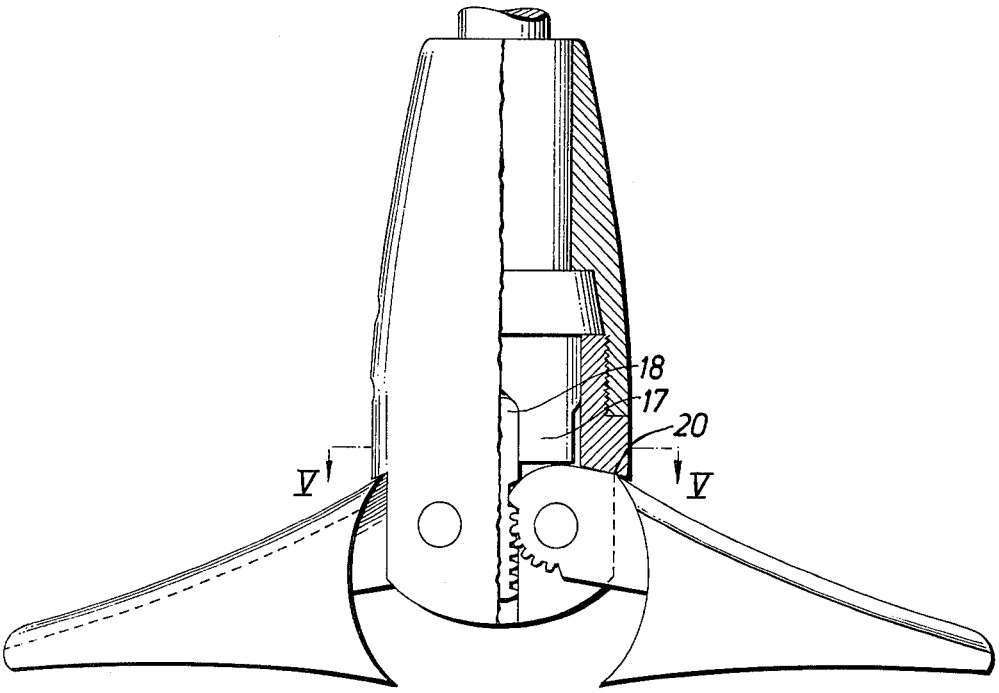
FIG. 3 shows the same view as in FIG. 2 but with opened out propeller blades.
Figure 4:
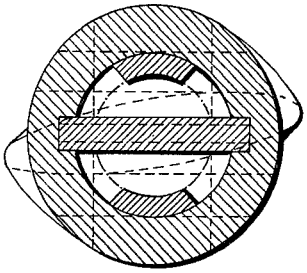
FIG. 4 shows the propeller with retracted blades according to the section along line IV — IV in FIG. 2.
Figure 5:
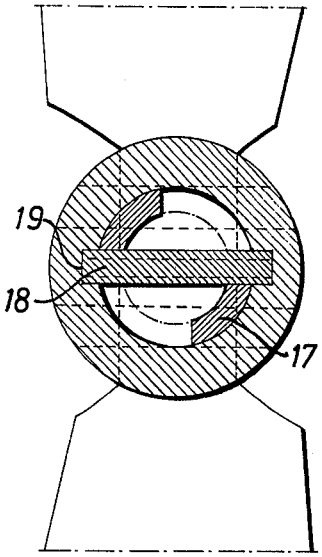
FIG. 5 shows the propeller with opened out blades according to the section along line V — V in FIG. 3.

As may be seen from the drawing, the retractable blades 16 are arranged pivotable on the rear portion 8 of the hub 4, 8 and on the stubs 13 between an outward working position (FIG. 3) and an inward inactive position (FIGS. 1 and 2). The hub 4, 8 of which the forward and rear portions are connected by means of thread 9 is limitedly rotatable in relation to the propeller drive shaft 1. The power and motion transferring transmission mechanism of the propeller blades 16, determining their pivoting position, namely the dog 11, gear segments 14, rack 15 and rack pins 18 connect the drive shaft 1 and blades 16. This transmission mechanism is arranged forcibly to open out the blades 16 at rotation of the propeller, as a result of the mutual turning movement between the drive shaft 1 and hub 4, 8.

The transmission mechanism forms a converter 11, 18 from the dog 11 and rack pins 18 for converting the mutual movement and torque between the drive shaft 1 and the hub 4, 8 to an axial movement for its element adapted for folding out the blades, i.e. the rack 15 with its pins 18, said element being connected to the respective blade 16 at a distance from its pivoting axis in the stubs 13 for transferring an axial blade opening force to the blade.

The dog 11 arranged unrotatably on the end of the drive shaft 1 has the shape of a sleeve, relative to which the hub 4, 8 is rotatably mounted. The sleeve 11 has two cam paths arranged peripherally with rises in either direction from a neutral position at its end opposite to the drive shaft 1. The rack 15 with its pins 18 forming the cam followers is axially movable and unrotatably attached in the hub 4, 8 due to the opposing guiding grooves 19 in the hub wall. Both pins 18 coact with the cam paths which are made as two diametrically opposing individually symmetrical and commonly congruent edge recesses in the wall of the sleeve 11, each coacting with one of the two cam followers, i.e. the pins 18.

For coaction with the propeller blades 16, the rack 15 with teeth on both sides extends centered between the blade stubs 13. Coacting parts of the blades form the gear segments 14.

Each edge recess in the sleeve 11 is terminated at each of its cam path ends with an end position stop for the pins 18, serving to limit the twisting movement between the drive shaft 1 and the hub 4, 8. The end position stops are active in a twisting position where the propeller blades 16 are swung out to engagement with each of their stops 20 on the hub.

The propeller functions in the following way: When reversing, the blades are opened out by starting the engine, its power being transmitted by the drive shaft 1, whereat the whole of the propeller mass is accelerated. The starting inertia forces compel the skew-cut dog 11 to turn relative to the hub 4, 8, thereby pressing the rack 15 backwards in the guiding groove 19 in the hub so that the propeller blades 16 by means of the gear segments 14 thereon are forced to turn round their stubs 13 and are opened out. The rack and gear segments also make the propeller blades open and close synchronously. When the propeller blades have opened sufficiently for them to begin to work, the acceleration and inertia forces diminish, and the propeller is exposed to a braking force contrary to the driving force, which in the same way via the dog 11, rack 15 and gear segments 14 together with centrifugal force compel the propeller blades to open completely. When the blades are completely open, the pin 17 rests against the forward portion of the rack for forward travel, this portion of the rack being formed as two pins 18 (FIG. 3) whereat the rack and gear segments are unstressed.

With travel forward, further to centrifual and inertia forces as with reversing, the forward impelling force comes into action its reaction force further compelling the propeller blades to open completely and press up against the stop 20 in the hub. The opening mechanism is then completely unloaded.

I claim:

1. A propeller driven by a propeller drive shaft rotatable in either a forward or reverse direction comprising a hub mounted for rotation with respect to said drive shaft for a limited period after the initiation of rotation of said drive shaft;

retractable blades disposed on said hub, each said blade being pivotably mounted on said hub and pivotable between an outward working position and an inward inactive position, each said blade including a gear segment portion;

a rack extending between said blades and coacting with the gear segments thereof, said rack being mounted for axial movement;

converter means for converting rotation of said propeller drive shaft in either its forward or reverse direction to an axial movement of said rack to thereby positively open said blades from said inward inactive position to said outward working position during said limited period of rotation of said drive shaft with respect to said hub, the positive opening of said blades occurring regardless of whether said drive shaft is rotating in either its forward or reverse direction.

2. A propeller as claimed in claim 1 characterized in that said converter means comprises (a) a sleeve unrotatably mounted on the end of the drive shaft, the hub being rotatably mounted relative to said sleeve, the sleeve having a cam path made with a rise in its end remote from the drive shaft and (b) a cam follower connected to said rack, said cam follower and rack being non-rotatably disposed with respect to the hub and said cam follower coacting with the cam path.

3. A propeller as claimed in claim 2, characterized in that the cam path on the sleeve comprises two diametrically opposed individually symmetrical and mutually congruent edge recesses in the wall of the sleeve, each coacting with its cam follower part.

4. A propeller as claimed in claim 3, characterized in that said hub includes at least one stop and each edge recess at each of the ends of the cam path is terminated with an end position stop for the cam follower to thereby limit said rotation between the drive shaft and the hub and effect rotation of the propeller blades after each has been opened out to engagement with said stop on the hub.

* * * * *